US010017281B2

(12) United States Patent
Hooper

(10) Patent No.: US 10,017,281 B2
(45) Date of Patent: Jul. 10, 2018

(54) PACKING EQUIPMENT WITH TWO RESTRAINING MEMBERS

(75) Inventor: Leon Hooper, Denistone (AU)

(73) Assignee: MANUFACTURING SOLUTIONS PTY LTD, Denistone (AU)

( * ) Notice: Subject to any disclaimer, the term of this patent is extended or adjusted under 35 U.S.C. 154(b) by 1079 days.

(21) Appl. No.: 13/990,900

(22) PCT Filed: Dec. 8, 2010

(86) PCT No.: PCT/AU2010/001662
§ 371 (c)(1),
(2), (4) Date: Sep. 17, 2013

(87) PCT Pub. No.: WO2012/075520
PCT Pub. Date: Jun. 14, 2012

(65) Prior Publication Data

US 2014/0075891 A1 Mar. 20, 2014

(51) Int. Cl.
*B65B 5/10* (2006.01)
*B65B 35/12* (2006.01)
(Continued)

(52) U.S. Cl.
CPC ..... *B65B 5/108* (2013.01); *B65B 5/08* (2013.01); *B65B 5/101* (2013.01); *B65B 35/12* (2013.01); *B65B 39/002* (2013.01)

(58) Field of Classification Search
CPC B65B 39/007; B65B 5/08; B65B 5/10; B65B 5/108
(Continued)

(56) References Cited

U.S. PATENT DOCUMENTS 5,033,367 A * 7/1991 Florindez ..... B65B 43/56 198/431
5,588,285 A 12/1996 Odenthal
(Continued)

FOREIGN PATENT DOCUMENTS

EP 2995561 A1 * 3/2016 ..... B65B 5/06
JP 4339705 11/1992
JP 4339705 10/2009

OTHER PUBLICATIONS

International Search Report and Written Opinion dated Jan. 20, 2011 in International Application No. PCT/US2010/001662.
(Continued)

*Primary Examiner* — Hemant M Desai
*Assistant Examiner* — Eyamindae Jallow
(74) *Attorney, Agent, or Firm* — Faegre Baker Daniels LLP

(57) ABSTRACT

There is presented a device and method for filling and advancing a series of containers including a first container and a next container. The device includes first and second assemblies having first and second restraining members respectively. The assemblies are positionable relative to each other in an object-receiving configuration in which the first restraining member and the second restraining member are inserted into the first container, and at least partially define a gap therebetween for deposition of an object. They are also positionable in a transitional configuration in which the second restraining member is raised relative to the first restraining member, and a lower portion of the second restraining member is positioned above and behind a leading internal face of the next container; and a container advancement configuration in which at least part of the second restraining member is in contact with and applying an
(Continued)

advancement force to the leading internal face of the next container.

16 Claims, 9 Drawing Sheets

(51) Int. Cl.
*B65B 39/00* (2006.01)
*B65B 5/08* (2006.01)

(58) Field of Classification Search
USPC ..... 53/235, 244, 255, 542
See application file for complete search history.

(56) References Cited

U.S. PATENT DOCUMENTS

| | | | | |
|---|---|---|---|---|
| 6,694,706 | B1 * | 2/2004 | Odenthal | B65B 5/101 53/201 |
| 7,213,386 | B2 | 5/2007 | Hooper | |
| 2005/0229548 | A1 * | 10/2005 | Hooper | B65B 5/08 53/475 |
| 2007/0186508 | A1 * | 8/2007 | Rovers | B65B 25/141 53/235 |

OTHER PUBLICATIONS

International Search Report and Written Opinion dated Jan. 20, 2011 in the International Application No. PCT/AU2010/001662.

* cited by examiner

PACKING EQUIPMENT WITH TWO RESTRAINING MEMBERS

CROSS-REFERENCE TO RELATED APPLICATION

The present application is a National Stage of International Application No. PCT/AU2010/001662, filed Dec. 8, 2010, the disclosure of which is expressly incorporated herein by reference.

FIELD OF THE INVENTION

The present invention relates to high-volume commercial packing processes and equipment. In particular, it relates to a device and procedure for sequentially guiding individual objects into a container, and is particularly (though not exclusively) useful in guiding flexible packages into a container.

BACKGROUND TO THE INVENTION

Many technologies exist for the packing of flexible packages, particularly bags or pouches, into containers. Some machines place or drop the packages flat in the container. Others position the packages vertically within the container. Most of the machines available to place bags or pouches in a packing case with a vertical orientation tend to be large, expensive and capable of very high speed operation. Robots are also frequently used for this task. Other machines stack the flexible packages horizontally in a stack which is pushed sideways into a case, the case then being tipped vertically.

The trend in many areas of manufacturing including the food industry is for more frequent product changeovers with shorter production runs. A concurrent trend is to reduce the number of packages in a shipping container. There is also constant economic pressure to reduce the cost, size and complexity of equipment, improve the flexibility of equipment and simplify processes.

A particular application of wide interest is the insertion of flexible bags or pouches, in one or more rows in a case or carton, where the bags or pouches are standing on end so that the top of every bag or pouch is visible from above. A machine which is suitable for this application is described in WO 2004/000649, the following parts of which are incorporated herein by reference: page 13, line 12 to page 18, line 9; and FIGS. 1 to 8.

The machine of WO 2004/000649 provides first and second moveable planar restraining members each having an anterior surface. The restraining members are removably insertable into a container such that their respective anterior surfaces define a temporary depositing cavity to receive a flexible package, thereby facilitating insertion of the flexible package into the container. Previously deposited packages are restrained against movement by a posterior surface of the first restraining member. Following deposition of a package into the cavity, the first restraining member may be withdrawn from its position on one side of the package, and reinserted so as to take up a new restraining position on the opposite side of the package, and the second restraining member may then be moved away from the first restraining member thereby to create a new cavity for the deposition of a further package.

Many known machines for filling cases collate the contents prior to inserting them into the case. The machine described in WO 2004/000649, on the other hand, deposits the flexible objects individually into the container to minimise the operations performed on each object and thereby increase the reliability of operation. A consequence is that the time available for removing the filled container and replacing it with an empty case is nominally only the time between successive objects being deposited, rather than the time between successive collated case loads.

One way of dealing with the relatively short changeover time between successive cases is to buffer the product being supplied to the cases, as described for example in Odenthal (U.S. Pat. No. 5,588,285) and Tokyo Automatic Machinery (Japanese Patent JP 04-339705). However, this requires additional machinery cost and also requires additional operations to be performed on the flexible packages. As a consequence, there are more opportunities for the packages to respond incorrectly, thus leading to jamming and interruption of the packing process.

In view of the above difficulties with known packing machines, it is an object of the present invention to provide a more efficient machine and method which can reduce the changeover time between successive cases, without the need for a buffering step.

SUMMARY OF THE INVENTION

Accordingly, the present invention provides, in a first aspect, a method of filling and advancing a series of containers including a first container and a next container, including the steps of:

(i) providing a first assembly including a first restraining member and a second assembly including a second restraining member;

(ii) positioning the first and second restraining members in the first container in an object-receiving configuration to at least partially define a gap therebetween;

(iii) depositing an object into the gap;

(iv) repeating steps (ii) and (iii) until the first container is full or filled to a desired capacity;

(v) when the first container is full or filled to a desired capacity, raising the second restraining member to withdraw it from the first container;

(vi) positioning a lower portion of the second restraining member above and behind a leading internal face of the next container so that the first and second assemblies are in a transitional configuration; and (vii) lowering the second restraining member into a container advancement configuration in the next container, whereby at least part of the second restraining member contacts and applies an advancement force to the leading internal face of the next container.

In a second aspect, there is provided a device for filling and advancing a series of containers including a first container and a next container, the device including:

a first assembly including a first restraining member, and a second assembly including a second restraining member;

wherein the first and second assemblies are positionable relative to each other in at least the following configurations:

(i) an object-receiving configuration in which the first restraining member and the second restraining member are inserted into the first container, and at least partially define a gap therebetween for deposition of an object;

(ii) a transitional configuration in which the second restraining member is raised relative to the first container, and a lower portion of the second restraining member is positioned above and behind a leading internal face of the next container to be insertable into the next container;

(iii) a container advancement configuration in which at least part of the second restraining member is in contact with and applying an advancement force to the leading internal face of the next container.

Using the second restraining member to advance the next container in the series allows the restraining members to be employed for multiple functions, including creation of a temporary depositing cavity for objects within a first container, and advancement of an empty next container in the series as part of the changeover between the filled first container and the empty next container. The advancement of the empty next container may also advance the filled first container, if the next container is close enough to contact the first container during at least part of the period in which the advancement force is applied. Since a similar high-speed set of movements can be performed for both functions, the time between deposition of the last object in the first container and the first object in the next container is reduced. The control of the device is also simplified because precise coordination of a separate container advancement mechanism with the restraining members is not required.

If an object is deposited while the first restraining member and the second restraining member are descending into the empty container, this object can be correctly deposited at the bottom of a first temporary depositing cavity created by the descending first and second restraining members within the new container. This allows an object to be deposited in the cavity before the cavity is completely formed. This results in the significant benefit of not requiring the supply of objects to be interrupted or buffered, thereby maintaining speed of operation and simplicity of object handling, particularly for flexible objects such as stand-up pouches.

Furthermore, the empty container need not be positioned as close to the lowered second restraining member as would be required if the first restraining member alone is to do the work in advancing the empty container into the required position and moving the filled container clear of the depositing position.

For the change from a filled first container to an empty next container, the second restraining member is withdrawn from the filled container. In a preferred embodiment, the second restraining member rotates away from the filled container towards and above the empty container. When a lower edge of the second restraining member is above and behind the leading internal face of the adjacent empty container, the second restraining member may be lowered into the empty container. Preferably, this is achieved by rotation of a hollow shaft to which a support arm of the second restraining member is mounted.

It is particularly preferred that the part or parts of the second restraining member which contact and apply the advancement force to the leading internal face of the next container are smooth (whether flat or curved), i.e. free of sharp corners or edges which might penetrate and thus cause damage to the leading internal face. For example, if the second restraining member is substantially planar and has a relatively thin lower edge, it is preferably oriented such that, on descent into the empty next container, its lower edge does not come into contact with the leading internal face.

Preferably, the method further includes the step of moving the second restraining member such that the second restraining member applies an additional advancement force to the leading internal face of the next container.

The surfaces of the second planar restraining member in contact with the container will then have a slight upwards motion relative to the next container as the member pivots forward while advancing both the empty and filled containers with the further benefit that the next container is not forced down against the supporting surfaces but instead may be lifted slightly, assisting reliable movement of the containers.

In one embodiment, the method further includes moving the second restraining member during step (v), for example by a small forward rotation or displacement during withdrawal from the filled container, to avoid contacting an interior surface of the filled first container.

During step (v) of the method, the restraining member actuator may be made to at least partly relax if the second restraining member experiences a reaction force from a trailing internal face of the first container, whereby the trailing internal face acts as a guide for the second restraining member as the second restraining member is withdrawn from the first container.

Preferably, the method further includes the step of rotating the second restraining member away from the first container to position the lower portion above and behind the leading internal face of the next container. Further movement of the second restraining member by pivoting away from the first container can help to ensure that the lower portion is clear of the trailing face of the first container and the leading face of the next container prior to lowering the second restraining member.

In a particularly preferred embodiment, the method includes, in the advancement configuration, the step of rotating the second restraining member to a position substantially parallel to the leading internal face prior to or during application of the advancement force. If the second restraining member is substantially parallel, the risk of damage to the leading internal face is reduced.

Preferably, the second assembly includes a restraining member actuator for independent movement of the second restraining member relative to the remainder of the second assembly. An independently movable second restraining member provides means of optimising the disposition of the second restraining member in the next container, and greater flexibility in the range of configurations available for the second assembly. The device may thereby be used with a greater range of container geometries. Furthermore, because the second restraining member can apply an advancement force during a substantial part of the deposition process, the work of advancing the most recently deposited object, all previously deposited objects and the container can be shared between the first and second restraining members. A longer part of the cycle time is available for the shared motion than in the arrangement of WO 2004/000649.

The first and second assemblies may be positionable in a second transitional configuration in which the second restraining member is raised relative to the first restraining member, and a trailing internal face of the first container at least partially defines, with the first restraining member, a gap for deposition of an object. This allows the second restraining member to be withdrawn from the first container at an earlier point, thus further decreasing the time required to change between the containers. The earlier withdrawal of the second restraining member from the container provides more space for the depositing of the final object, thereby increasing the volumetric packing efficiency.

The independent movement of the second restraining member is preferably rotational. Rotary motion is more reliable than linear motion, and produces less wear on the device components.

In one particularly preferred embodiment, in the container advancement configuration, the independent movement of the second restraining member results in an additional advancement force being applied to the leading internal face of the next container. In the object-receiving configuration, the independent movement results in application of an additional advancement force to previously deposited objects. The independent application of an additional advancement force in the container advancement configuration enables earlier insertion of the first restraining member into the next container such that the two assemblies are in the object-receiving configuration, ready for the object deposition cycle to begin.

The second assembly may include a support arm to which the second restraining member is pivotally mounted. The support arm and the second restraining member may be coupled by a linkage assembly arranged to impart movement to the second restraining member at least during some stage of pivotal movement of the support arm.

The use of a linkage assembly can automatically provide some, or even all, of the movement of the second restraining member which is used to advance the next container and/or the first (filled or partially filled) container. This reduces the work required to be done by independent movement of the second restraining member by the second restraining member actuator.

In one embodiment, the support arm is mounted to a hollow shaft. The hollow shaft may house an internal shaft to which the second restraining member is mounted. A concentric shaft arrangement of this type allows the movable support arm and second restraining member to be separated from the actuators which drive their movement. The weight of any actuators thus does not need to be borne by the moving components of the assemblies, increasing the reliability and operational life of the device.

The first assembly is preferably similar in construction to the second assembly, but enabled to rotate in the opposite sense during operation of the device. Symmetry between the two assemblies may simplify construction and control of the device.

In one preferred embodiment, the device further includes at least one position sensor for monitoring the position of the first and/or second restraining members to detect when the first and second assemblies are in the object-receiving configuration. The position sensor or sensors may be located remotely from the restraining member. For example, an angular position sensor may be located at an end of the internal shaft opposite an end to which the support arm is mounted.

Physical separation of the actuators and position sensors from the restraining members is beneficial because not only does it reduce the weight of the assemblies, it also allows the actuators and sensors to be enclosed whilst leaving the restraining members exposed to perform their container filling function. The sensors and actuators may be located within an enclosure with rotary seals acting on the hollow external shafts and the internal shafts, and with rotary bearings supporting the concentric shaft assemblies. Rotary bearings and seals are more reliable and longer lived than linear bearings and seals and so provide improved operational reliability of the device.

The concentric shaft configuration is robust and resistant to damage. This further improves reliability of operation as well as improving the ease of cleaning the mechanism which is extremely important for some potential applications of the device such as in the food industry. The enclosure of the actuators also reduces the hazard presented to operators.

The separation of the position sensing from the planar restraining members also allows the position sensing to remain in place when the planar restraining members are exchanged for wider or narrower units to suit wider or narrower cases.

Preferably, the first restraining member includes fingers which are interleavable with fingers of the second restraining member. The fingers are preferably in the form of cylindrical rods or rods with smooth or rounded edges so as to reduce the risk of damage to the containers or the deposited objects.

If position sensors are provided as described above, interleaving of the first restraining member through the second restraining member can be detected directly by monitoring the positions of both of the supporting arms and both of the planar restraining members, thus permitting initiation of the descent of the first restraining member into the container with assurance that the first and second restraining members are interleaved and remain interleaved during the descent. The first restraining member may remain in the advanced position during the descent. This provides ample separation of the lower edge of the first restraining member from a deposited object until downward movement has finished or nearly finished. Sufficient separation is provided such that any possibility of bag damage caused by the descending lower edge of the first restraining member contacting and damaging a bag is further reduced.

The second assembly may include a guide plate mounted to the second restraining member to limit the interleaving of the first restraining member with the second restraining member, thus preventing descent of the lower edge of the first restraining member beyond a trailing face of the first container.

In one embodiment, the device further includes a container advancement assembly which is positionable to partially advance the next container and to guide the second restraining member into the next container. If the second restraining member includes a guide plate, the container advancement assembly also acts to direct the guide plate into the next container. A container advancement assembly which is suitably positioned relative to the second assembly can assist in guiding the second restraining member (and guide plate, if present) into the next container if the second restraining member is retracted close to or beyond a trailing end of the next container, as may happen for a short container if the second assembly is not adjusted correctly, or to avoid or reduce the need for adjustment.

In one embodiment, the container advancement assembly is capable of interleaving with the first and second restraining members. This obviates the need for the container advancement assembly, if present, to be fully withdrawn before the first and second restraining members begin their descent into the newly positioned empty case. This further reduces the time required for changing from one container to another.

In a further aspect, the present invention provides a first restraining assembly for use with a device for filling and advancing a series of containers including a first container and a next container, the first restraining assembly including a first restraining member, wherein the first restraining assembly is positionable relative to a second similar restraining assembly in at least the following configurations:

(i) an object-receiving configuration in which the first restraining member is inserted into the first container and at least partially defines, with a second restraining member of the second restraining assembly, a gap for deposition of an object;

(ii) a transitional configuration in which the second restraining member is raised relative to the first assembly, and a lower portion of the second restraining member is positioned above and behind a leading internal face of the next container to be insertable into the next container; and (iii) a container advancement configuration in which at least part of the second restraining member is in contact with and applying an advancement force to the leading internal face of the next container.

BRIEF DESCRIPTION OF THE DRAWINGS

Preferred embodiments of the invention will now be described, by way of non-limiting example only, by reference to the accompanying figures, in which.

DESCRIPTION OF PREFERRED EMBODIMENTS

Figure 1:
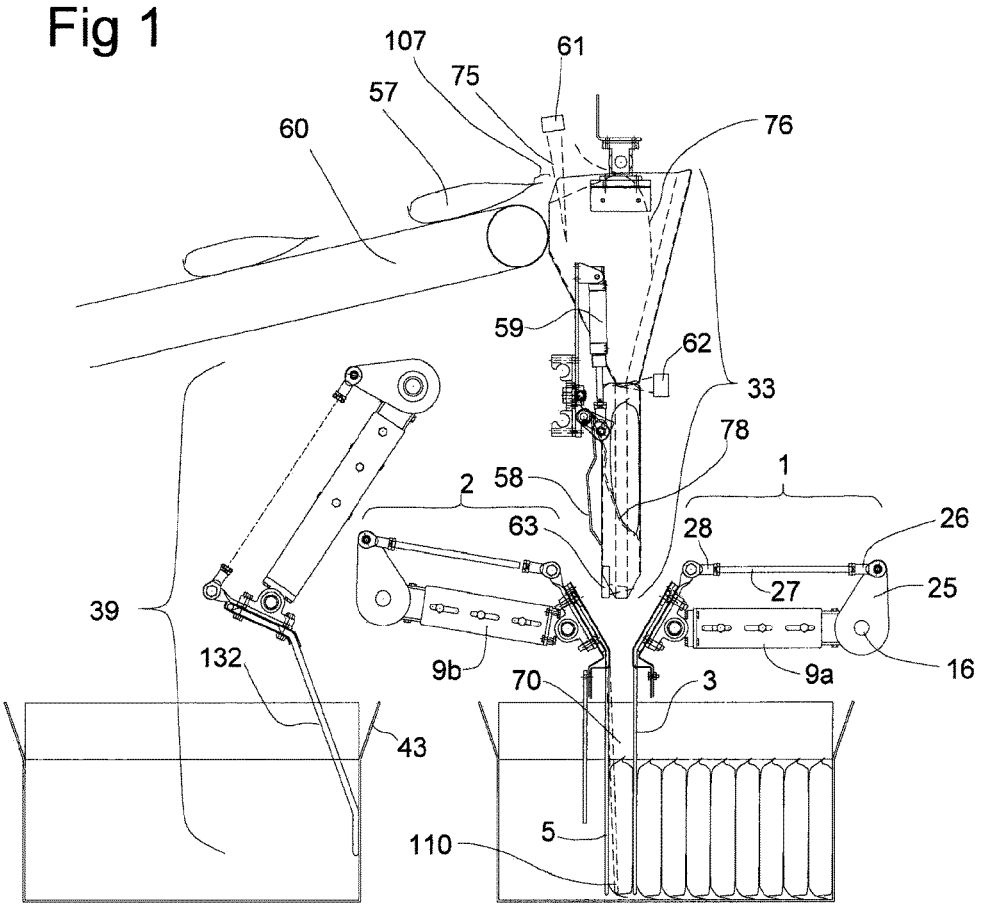
FIG. 1 is a side view of a machine for filling and advancing cases according to one embodiment of the invention.
Figure 2:
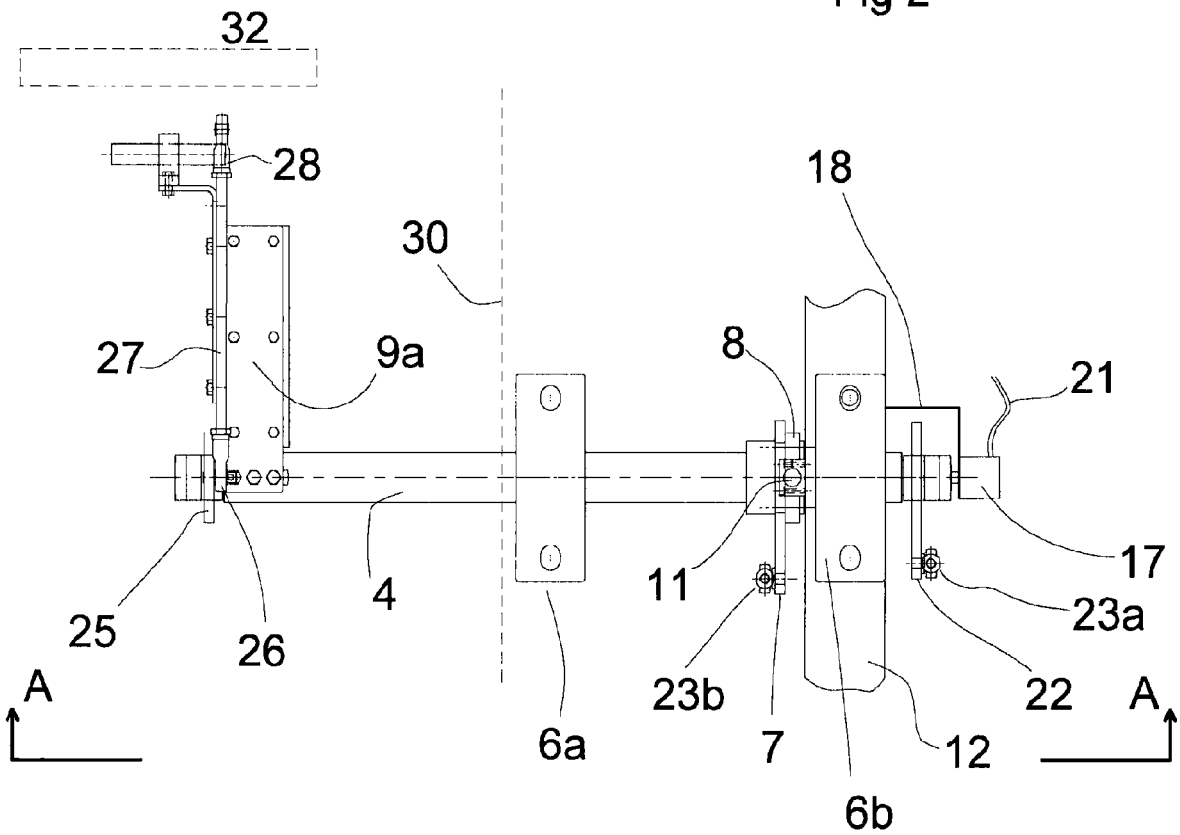
FIG. 2 is a top plan view of part of the machine of FIG. 1.
Figure 3:
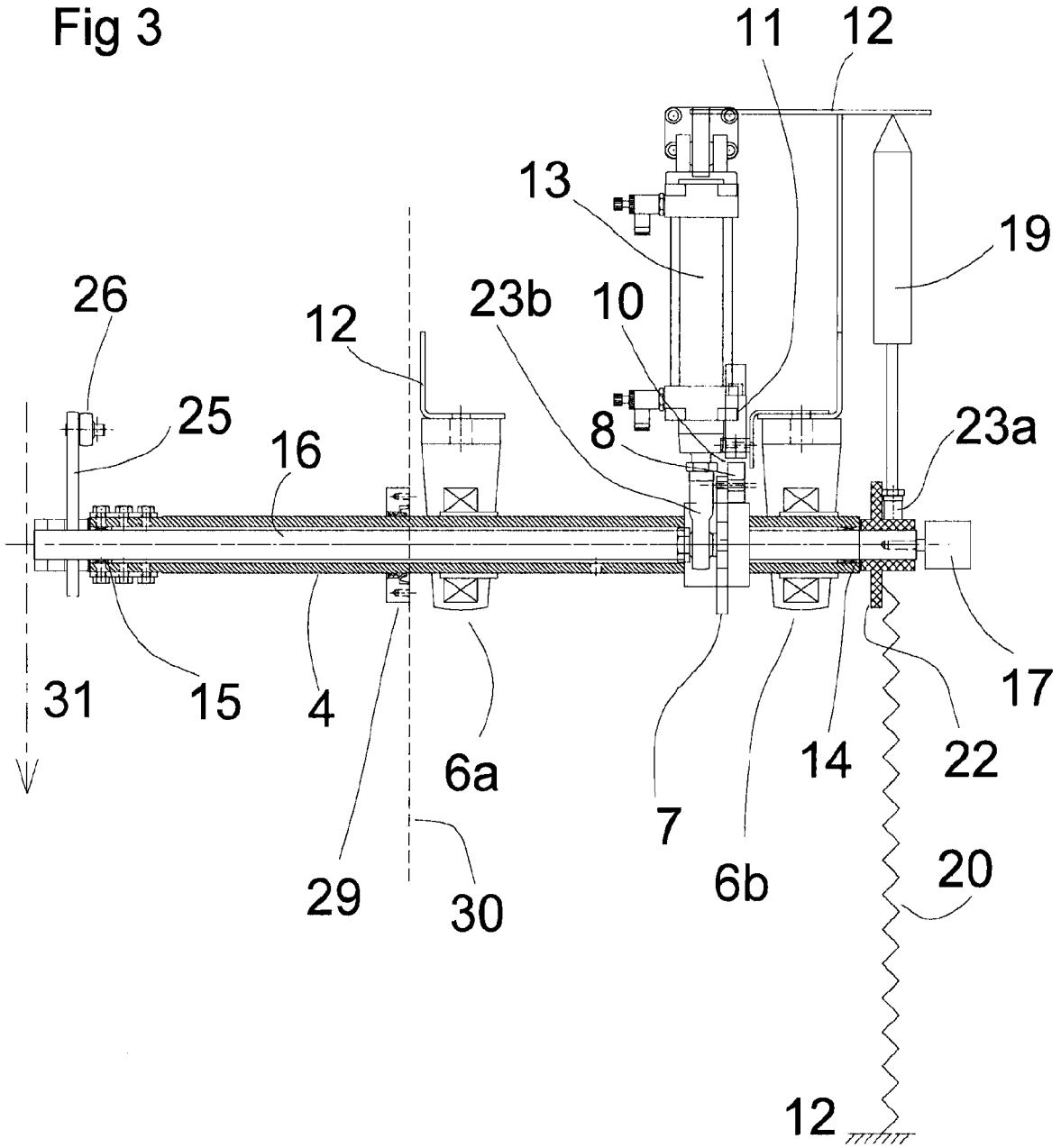
FIG. 3 shows a section of FIG. 2 along the line A-A.

Referring to FIG. 1 generally, there is shown a device for depositing packages 57. The device includes a chute assembly 33 through which packages descend towards first assembly 1 and second assembly 2. First assembly 1 includes first restraining member 3 and second assembly 2 includes second restraining member 5. The assemblies 1, 2 are mounted to a frame 12 (FIGS. 2 and 3).

Restraining members 3, 5 are substantially planar and are pivotally mounted to support arms 9*a*, 9*b* respectively. Each restraining member includes a plurality of fingers (not shown). The first and second restraining members are arranged such that the fingers of first restraining member 3 can interleave with those of the second restraining member 5.

The device also includes container advancement means 39.

In operation of the device, a bag 57 is conveyed to the top of the chute 33 by an infeed conveyor 60. The bag 57 is detected by a photoelectric proximity sensor 61 as the leading edge of the bag 57 interrupts beam 75 of proximity sensor 61. This provides the machine controller (not shown) with an update of the position of bag 57 as it approaches the chute 33. Bags may slip on the infeed conveyor 60 and the position update provided by sensor 61 removes the bag position uncertainty introduced by this slipping. Other types of non-contact sensor that can reliably detect a moving bag may be used in place of sensor 61.

The bag 57 is shown in FIG. 1 with its thinner end leading, but may alternatively be supplied by infeed conveyor 60 with the thicker end leading. The device may handle a diverse range of bag shapes and bag weight distributions.

When the bag 57 has dropped into the chute 33, it will move out of the beam 75 of sensor 61 signalling to the machine controller the instance of the bag 57 dropping into the chute, which the machine controller can relate to the motion of the bag 57 on conveyor 60 from first detection by sensor 61 until drop-in to update estimates of how far a bag must be advanced by the conveyor 60 after detection until it falls in.

Even if bags are placed end to end on the infeed conveyor 60, the small overhang distance 107 will in most instances provide a gap in the signal from sensor 61. The bag 57 is shown fully supported by the infeed conveyor 60. As the conveyor 60 advances, the bag 57 will start to overhang the end of the conveyor. When the bag 57 has advanced sufficiently that its centre of gravity is no longer supported by the conveyor 60, the bag 57 will tip and fall into the chute assembly 33 and will move down out of the beam 75. The momentum of its forward motion will contribute to the bag continuing to move forward. If the next bag on the infeed conveyor 60 is touching bag 57, this action of the bag 57 falling below the beam before being conveyed completely off the infeed conveyor 60 will break the signal from sensor 61 enabling detection of the leading edge of the next bag and thus updating the position value of this bag also. It is preferable that the bags be separated but this configuration of the conveyor 60, chute 33 and sensor beam 75 with the distance 107 is able to distinguish adjacent bags on the infeed conveyor 60, thus improving its operational reliability.

The upper part of the chute assembly 33 is shown with a nominally triangular section to allow the end of bag 57 to rotate down as bag 57 falls off the end of the conveyor 60. If the bag 57 is moving very quickly, it may be desirable to provide a curved guide 76 which uses the momentum of the bag 57 supplied from conveyor 60 to steer bag 57 from nominally horizontal to vertical motion. The dashed line 76 indicates a nominal curve for such a guide.

The skilled person will appreciate that care should be taken in the arrangement of the chute 33 and the guide 76, if this is present, to avoid an opportunity for the bag 57 to wedge itself in the gap between them.

The sensors 62 and 63 monitor the travel of the bag down the chute 33 to track movement towards the cavity. The holdup finger lever shown retracted at 58 and advanced at 78 by actuator 59 is advanced to catch and hold a bag falling in the chute 33 if the machine controller predicts the bag will arrive too early in the container, before there is a cavity to accept the bag. The finger retracts to position 58 when the bag is permitted to resume falling. For fast operation of the machine, a bag 57 falls from the end of conveyor 60 before the cavity 70 is presented based on predicted timing of bag fall and cavity recreate cycle duration. The holdup finger allows an intervention to protect the bag from damage if a prediction is wrong. FIG. 1 shows a bag in cavity 70, with another bag supported on the finger 78 which will be allowed to resume falling when an empty cavity has been recreated.

The sequence of cavity creation, bag deposition and container changeover will now be described by reference to FIGS. 1 to 5.

The first assembly 1 is of similar construction to the second assembly 2. In particular, supporting arms 9*a* and 9*b* are controlled in similar fashion to be moved rotationally, with the rotation of supporting arm 9*a* having the opposite sense to the rotation of supporting arm 9*b*. Referring to FIGS. 2 and 3, there is shown first assembly 1 including a hollow external shaft 4 supported by rolling bearings 6*a* and 6*b*. A supporting arm 9*a* is attached to one end of hollow external shaft 4, and a lever 7 is attached to the shaft 4 between the bearings 6*a* and 6*b*. A cam section 8 is attached to the lever 7, and a rod end or rod eye 23*b* is attached to the lever 7. The operation of an actuator 13 on the rod end 23*b* will move the lever 7, rotating the hollow shaft 4 about its central axis and thus rotating the supporting arm 9*a* which pivotally supports the planar restraining member 3. Movement of the lever 7 also moves the cam section 8 which is positioned and shaped such that the rotation of hollow shaft 4 will change the gap 10 between the cam 8 and the distance sensor 11, with increase in the gap 10 corresponding to rotation of hollow shaft 4 in one direction and decrease in the gap 10 corresponding to rotation of hollow shaft 4 in the other direction. One example of a suitable distance sensor 11 is an analogue inductive proximity sensor which allows the analogue signal provided to be interpreted by the machine controller as representing the gap 10 and thus the angular position of the supporting arm 9*a* at that moment. The distance sensor 11 is rigidly mounted on the frame 12. The other end of hollow shaft actuator 13 is also attached to the frame 12. There is no contact between the sensor 11 and the moving cam 8. Advantageously, this avoids wear-out modes and shock loadings, thereby providing very long operational life.

The hollow shaft actuator 13 may be a pneumatic cylinder. To start the hollow shaft actuator 13 moving by reversing the application of air pressure, there will usually be a delay of the order of 150 milliseconds before any movement is apparent. To reduce this delay, venting air pressure from the cylinder 13 when the first restraining member 3 has been lowered will allow for a very rapid start of movement. To avoid damaging the hollow shaft actuator 13 when it reaches the end of its stroke, it is highly desirable to supply a pulse of air into the cylinder 13 to oppose the current motion. This air pulse replaces some of the air that was vented earlier and acts to decelerate the hollow shaft actuator 13. The duration of venting and the duration and positioning of the deceleration air pulse within the movement of the actuator 13 are both controlled by the machine controller. With suitable software for the controller, this allows different speeds of operation and different planar restraining members to be attached to the machine without requiring manual changes to the actuator settings. Similar control strategies can be applied to other actuators.

Bearings 14 and 15 are mounted in the ends of the hollow shaft 4 and support the central internal shaft 16 concentrically within the hollow external shaft 4. The angular position of the central shaft 16 is monitored by the rotary position sensor 17 which is secured rotationally by the bracket 18 which is attached to the frame 12. In one embodiment, the rotary position sensor 17 is a quadrature shaft encoder connected to a suitable counter. The electrical cable 21 for the rotary position sensor 17 does not move as the central internal shaft 16 rotates. This improves the duration of reliable operation.

A lever 22 is attached to the central internal shaft 16. A rod end 23*a* connects restraining member actuator 19 to the lever 22, preferably by means of a bolted connection. Extension and retraction of the restraining member actuator 19 causes rotation of the central shaft 16 which is measured by the rotary position sensor 17. This configuration uses venting of the restraining member actuator 19 to allow the first planar restraining member 3 to adjust its position as it is withdrawn from the case during the cavity recreation cycle. In an alternate embodiment, if rod end 23*a* is replaced by a flexible connection between restraining member actuator 19 and lever 22 with the spring 20 acting in nominal alignment with restraining member actuator 19, the actuator 19 can extend without moving the lever 22, allowing the first planar restraining member 3 to be guided primarily by the bags on either side as planar restraining member 3 is withdrawn from a case. The mechanical configuration shown in FIGS. 2 and 3 has the consequence that very small lateral forces applied by these bags will overcome substantial forces applied by the spring 20. The spring 20 causes the first planar restraining member 3 to rotate towards the second planar restraining member 5 after being lifted clear of the deposited bags, with the extent of rotation being limited by the actuator 19 when the flexible connection is taut, or by some other stopping means to limit the motion caused by spring 20.

A length of roller chain may be used as a flexible connection between restraining member actuator 19 and lever 22. A roller chain is stiff in tension and very flexible in compression. Various types of woven, cast, extruded or composite belt may also be suitable. A mixture of controlled positioning and controlled force application by actuator 19 can also provide the initial desired self-alignment of the first planar restraining member 3 followed by rotation to interleave with the second planar restraining member 5, with the rotation limited to prevent the rotation continuing to unwanted positions and possibly hitting the chute 33. Alternately, separate mechanisms can limit the rotation of lever 22 and hence of the first planar restraining member 3.

Rotation of the central internal shaft 16 in the bearings 14 and 15 causes rotation of the lever 25. This results in motion of the rod end 26, the connecting rod 27 and the rod end 28, resulting in rotation of first planar restraining member 3. The pivoting movement of the planar restraining member 3 is independent of the supporting arm 9*a* and the actuator 19 is supported by the frame 12. In combination, the rotary position of the supporting arm 9*a* and the planar restraining member 3 are independently controlled over a desired range of movement with the angular position of both measured continuously. In a paired configuration as shown in FIG. 1, the dimensions of the cavity between the planar restraining members 3, 5 and the extent of interleaving of the planar restraining members 3 and 5 are always directly calculable.

The actuators, sensors and mechanism support bearings may be positioned behind an enclosure wall 30 with a rotary seal assembly 29 to prevent any contaminants passing in either direction. A nominal centre line of the chute 33 vertically aligned is shown as 31 and a nominal bag deposition position is outlined as 32. Both are well separated from the actuators 13, 19 and sensors 11, 17. Alternatively, bearing 6*a* and seal 29 may be replaced by a suitable bearing mounted in the enclosure wall 30 and such a bearing may also incorporate a rotary seal.

Referring now to FIGS. 4*a* to 4*f*, there is shown a cavity recreate cycle within a case being filled by the device of FIG. 1.

Figure 4A:
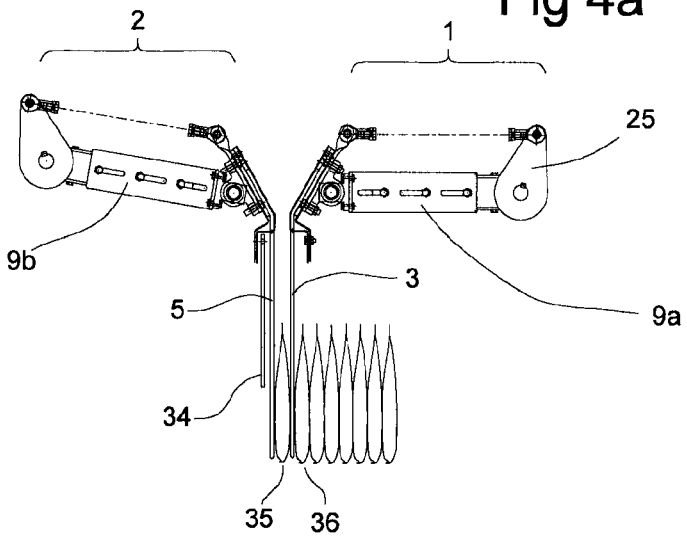
FIGS. 4*a* to 4*f* show one iteration of the sequence of movements required to recreate a cavity within a case.

FIG. 4*a* shows the first and second assemblies 1, 2 positioned relative to each other in an object-receiving configuration in which first restraining member 3 and second restraining member 5 are inserted into a first container (not shown) which holds bags 35, 36. A gap or cavity formed between the two restraining members is presented with a bag 35 shown deposited in the cavity. The position of the first planar restraining member 3 is determined by the position of restraining member actuator 19, and measured by rotary sensor 17. The position of the supporting arm 9*a* is determined by the hollow shaft actuator 13, and measured by the distance sensor 11 which interacts with the cam 8.

Figure 4B:
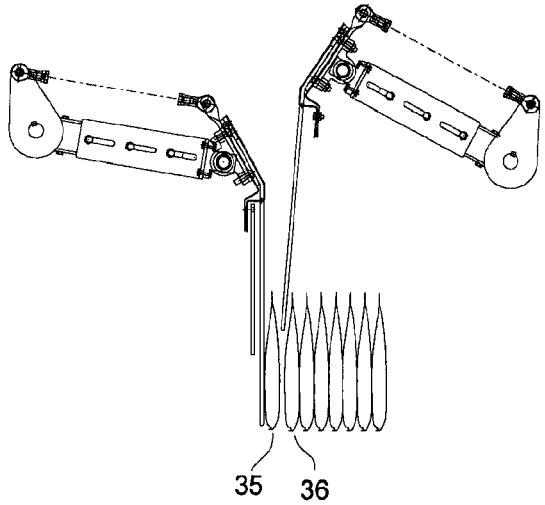

FIG. 4*b* shows the first planar restraining member 3 being raised by the supporting arm 9*a*. The lower edge of the planar restraining member 3 is permitted to self align to equalise and thus minimise the forces applied to and by the bags 35 and 36, where bag 36 was deposited and then restrained by the previous cavity recreate cycle. The objective of doing so is to avoid lifting a bag while retracting the planar restraining member 3.

During this part of the cycle, the restraining member actuator 19 does not control the position of the first restraining member 3. A small defined force may be applied by other means to the lever 22 and thus to the central shaft 16, thus to the lever 25 and thus via the rod eye 26, the linkage 27 and the rod eye 28 to the planar restraining member 3 to encourage the lower edge to rotate towards the second planar restraining member 5. The small loadings applied at the lower edge of the planar restraining member 3 by bags 35 and 36 are magnified by mechanical advantage to move the actuator 19 which, in this part of the cycle, is in a passive mode and over-rides the force applied by optional spring 20. The lower edge of the first planar restraining member 3 is intended to move towards the second planar restraining member 5 when raised clear of the bag 35. The optional spring 20 that acts in opposition to restraining member actuator 19 can also provide this comparatively small defined force to move the first planar restraining member 3 towards the second planar restraining member 5. The bags 35 and 36 experience only very small forces from either restraining member actuator 19 or the spring 20.

If actuator 19 is not capable of applying only a small force and having its position adjusted by the lever 22 according to the reactive loading applied by the bags 35 and 36 to the lower end of the first planar restraining member 3, then actuator 19 can be coupled to the lever 22 by a flexible linkage such as a chain so that when the actuator 19 is extended, with the flexible linkage slack, the lever 22 is loaded solely by the spring 20 and the position of the lower edge of the first planar restraining member 3 is thus controlled mainly by the bags 35 and 36. This is desirable to equalise the pressure applied by the bags 35 and 36 to each side of the first restraining member 3, thus minimising the pressure applied to either bag 35 and 36 which minimises friction between bag and moving restraining member and thus minimising the likelihood of a bag being lifted as the first restraining member 3 is withdrawn from the container. Rapid withdrawal also helps because the inertia of the deposited bags is more likely to mean they do not rise.

Figure 4C:
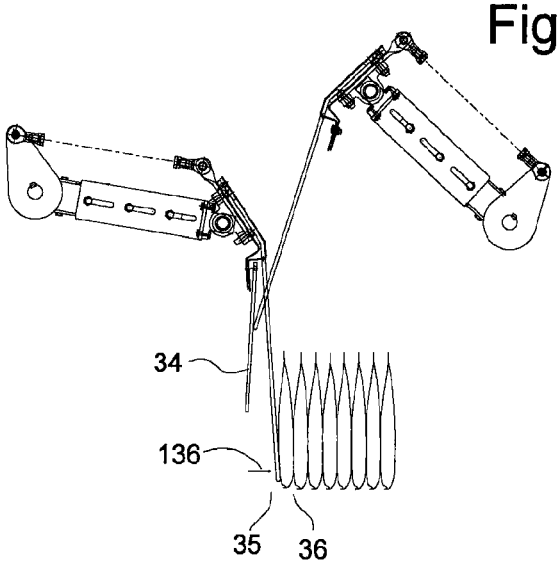

FIG. 4*c* shows another configuration of the assemblies 1, 2 in which the lower edge of the first planar restraining member 3 is interleaved with the second planar restraining member 5 and is possibly partially displacing the hanging plate 34. Hanging plate 34 mounted to second restraining member 5 may swing relatively freely and is advantageous when inserting the last few objects in a container because it acts to guide the fingers of first restraining member 3 into the container if there is any tendency for the fingers to overshoot the end of the container.

In FIG. 4*c*, the lower edge of the second planar restraining member 5 has advanced due to the action of the restraining member actuator to which it is coupled. Second restraining member 5 thus provides the force to move the bags 35, 36 and the case forward, and the equivalent to position sensor 17 for the second planar restraining member 5 monitors this movement 136. The second planar restraining member 5 can perform part or all of the case movement required rather than have the first planar restraining member 3 do this during the final stages of the cycle, which improves the speed of operation.

The forward movement of the lower edge of second restraining member 5 also provides several other benefits. It moves forward and slightly upward relative to the lower edge of the most recently deposited bag 35 and slightly raises the bag 35 from the bottom of the container as the bag 35 moves towards the previously deposited bags which aids reliable compaction of the restrained bags. Note that the first planar restraining member 3 applies compression and restraint to bags by retracting towards the deposited flexible objects, while the second planar restraining member 5 applies compression and restraint to bags by extending towards the deposited flexible objects.

When the lower edge of the first planar restraining member 3 is interleaved in the second planar restraining member 5 (this being confirmed by the position measurements of both planar restraining members and the support arm 9*a*), then the support arm 9*a* may be lowered to lower the planar restraining member 3 with confidence that the lower edge of the first planar restraining member 3 can not touch and so can not damage the bag 35.

Figure 4D:
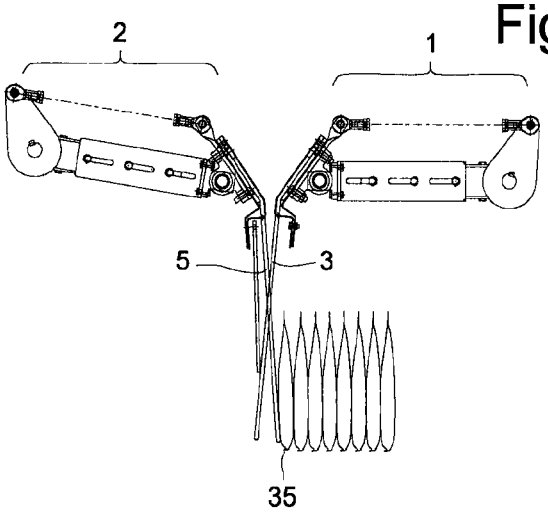

FIG. 4*d* shows a configuration in which the support arm 9*a* and hence the first planar restraining member 3 are lowered while both the first planar restraining member 3 and the second planar restraining member 5 remain extended, with this extension being monitored during the descent. The lower edge of the first planar restraining member 3 is thus maintained at a sufficiently large distance from the bag 35 to minimise the risk of bag damage while maintaining restraining compression on the previously deposited bags and preventing slumping of the bag contents during the cavity recreation cycle. If the positions of either planar restraining member change sufficiently during the descent of the first planar restraining member, the machine controller may decide that there is a probability of bag damage and arrange a withdrawal of both planar restraining members from the container and a change to a new empty container with the partially filled container diverted from the normal container movement for subsequent operator inspection.

Figure 4E:
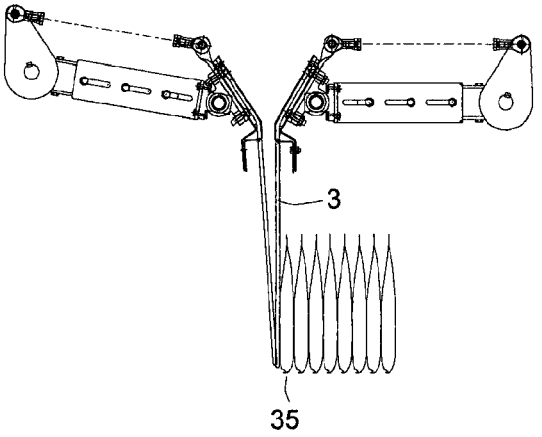

FIG. 4*e* shows a configuration of the first and second assemblies in which the first planar restraining member 3 is retracted to a vertical position. The position is controlled by the restraining member actuator 19 and measured by the rotary sensor 17.

Figure 4F:
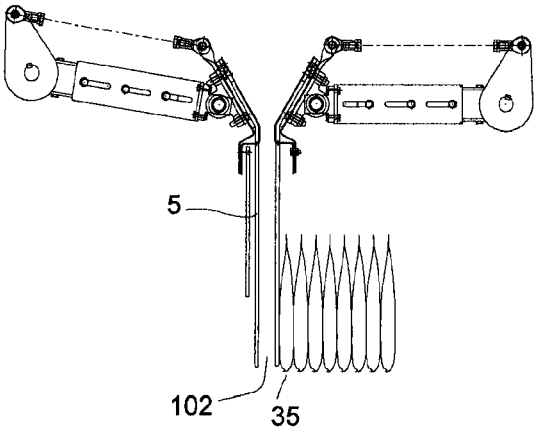

FIG. 4*f* shows a configuration in which the second planar restraining member 5 is retracted to complete the definition of a new cavity 102. The second planar restraining member 5 could be positioned with a taper towards the bottom to guide the bag closer to the previously restrained objects, and also to initially decelerate and stop the fall of the bag with more of the bag content in the upper part of the bag to enable subsequent bag shaping to improve the volumetric efficiency of packing. A tapered cavity allows the top of the cavity to accommodate an oversized bag which would otherwise be wider than the usual cavity width, so that when the oversized bag falls towards the bottom of the cavity, it can be partially compressed by the taper. Dashed outline 110 in FIG. 1 shows such a tapered cavity. The second planar restraining member 5 could also be positioned vertically, if this suits the characteristics of the bags. The motions shown separately in FIGS. 4*e* and 4*f* can also be performed simultaneously or with some overlap.

FIGS. 4*a* to 4*f* are intended to be illustrative of the motions of the restraining members, rather than indicating the precise sequencing. Persons skilled in the art will understand that some motions may be started before preceding motions have completed to improve speed or reliability of operation or to suit the specific needs of particular flexible objects and containers.

FIGS. 5*a* to 5*f* show the cavity recreate cycle after filling a case and completing changeover to a new case.

Figure 5A:
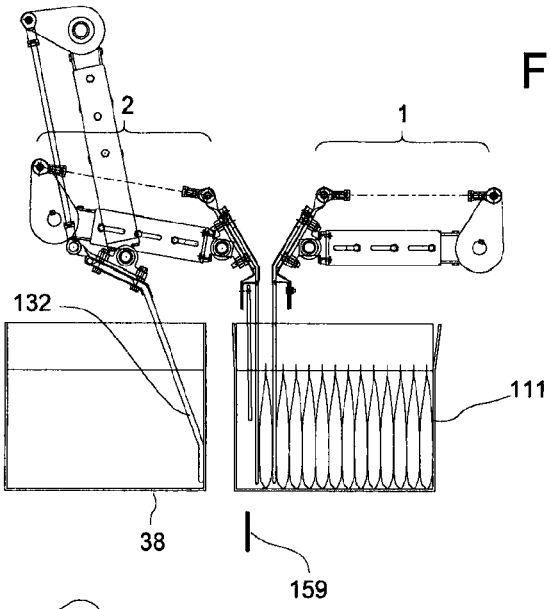
FIGS. 5*a* to 5*i* show the sequence of movements required to recreate a cavity within a new case after a previous case has been filled to a desired capacity.
Figure 5B:
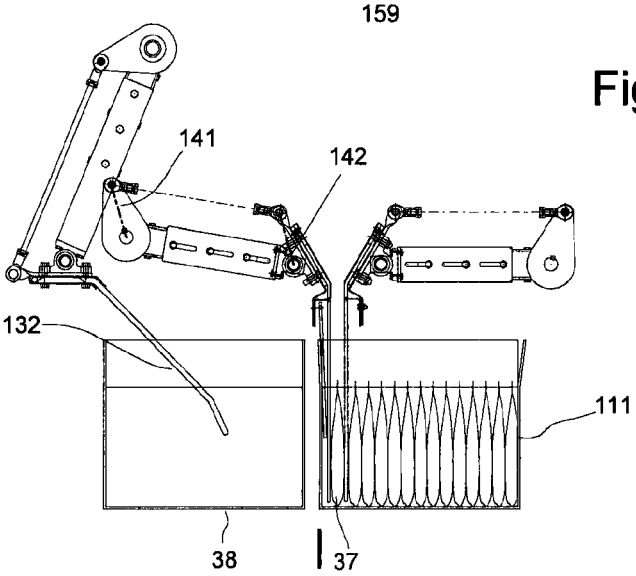

FIG. 5*a* shows the first and second assemblies in the object-receiving configuration, the restraining members defining the second last cavity of a first container 111 presented with a bag deposited in the cavity. The next case 38 in the series of cases is shown being advanced by the case advance fingers 132 which are part of a case advance assembly 39. The position of the empty case 38 and the case advance assembly 39 should preferably be as shown in FIG. 5*b* before the last bag 37 is deposited, to minimise the cycle duration. The fixed position mark 159 provides a reference against which to compare the movement in the FIGS. 5*a* to 5*f* of cases 111 and 38 during the stages of changing from a filled case to a new case.

FIG. 5*b* shows the first and second assemblies in the object-receiving configuration, the last cavity filled with a bag 37 and the case advance mechanism fingers 132 already partially withdrawn. The case 38 can be advanced to touch the case 111 if so desired but a benefit of this embodiment is that such close proximity is not required. The lines 141 and 142 show the effective lever arm geometry that transfers rotation of the internal central shaft to the second planar restraining member 5.

Figure 5C:
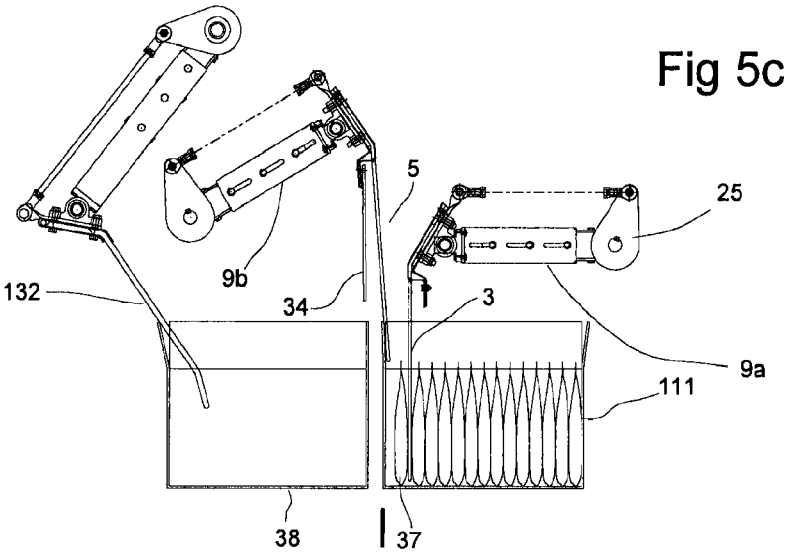

FIG. 5*c* shows the second assembly 2 in a configuration in which the second planar restraining member 5 is sufficiently withdrawn from the filled first case 111 that it no longer contacts the most recently deposited flexible object 35. The first planar restraining member 3 can begin withdrawing. The removal of the second planar restraining member 5 and the hanging plate 34 will provide some additional space within the case allowing the bag 37 to move away from the first planar restraining member 3. Preferably, the planar restraining members are withdrawn sequentially to minimise the risk of object 37 being lifted.

If the actuator that positions the second restraining member is able to selectively allow adaptive movement in response to small forces applied to the lower edge of the second restraining member during withdrawal, excessive force on the internal face of the container will be avoided. Several useful methods have been described for adaptive positioning of the first planar restraining member during withdrawal, including venting of the actuator and the use of a spring. This would allow adaptive retraction of the second restraining member while minimising forces applied whereas the previously described embodiment allows selective extension of the first restraining member.

Figure 5D:
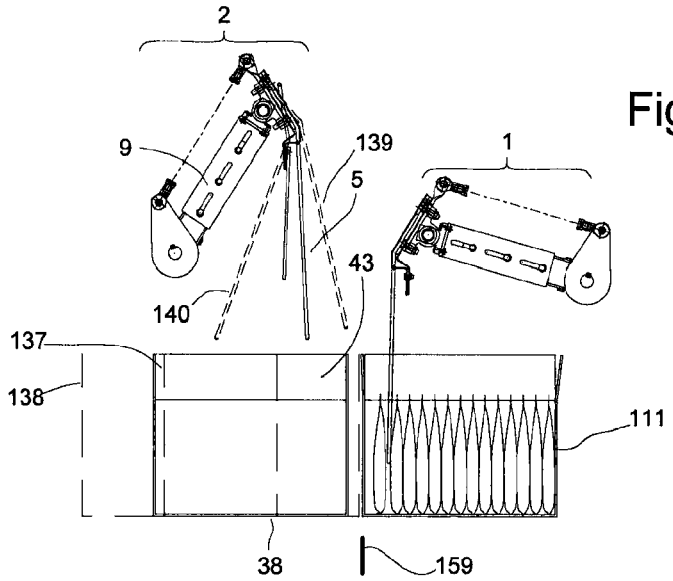

FIG. 5*d* shows the first planar restraining member 3 partially withdrawn from the filled first case 111 and the second planar restraining member 5 retracting over the empty next case 38. The position 139 may be an intermediate position for the second planar restraining member. The position 140 is the nominal final position for the fully retracted second planar restraining member 5. In the position 140, the first and second assemblies are in a transitional configuration in which the second restraining member 5 is raised relative to the first restraining member 3, and a lower portion of the second restraining member 5 is positioned above and behind a leading internal face of the next container 38.

Dashed outlines 137 and 138 show alternative positions of case 38 which can be accommodated by position 140 of second restraining member 5.

Figure 5E:
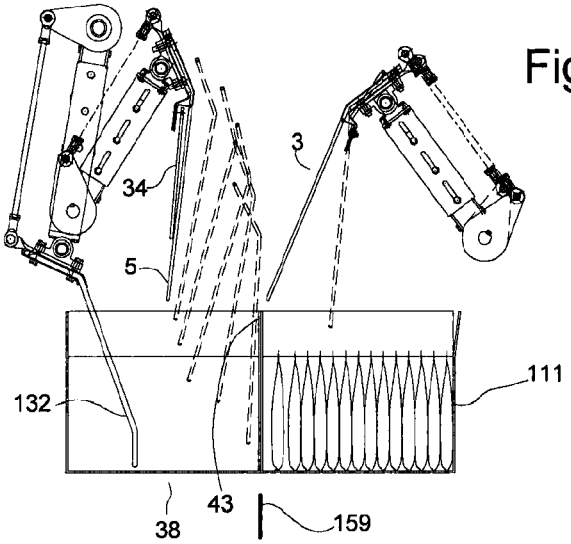

FIG. 5*e* shows the second planar restraining member 5 descending into the case 38 and also returning to a more vertical orientation as the support arm 9*b* lowers. Several dotted outlines show one series of positions the second planar restraining member 5 may pass through as it descends. In the final dotted outline position, the assemblies are in a container advancement configuration in which part of second restraining member 5 is in contact with and applying an advancement force to the leading internal face of case 38. Case 38 has advanced relative to the position 159 due to the advancement force applied by the second restraining planar member 5 on the inside leading face of the case 38. The first planar restraining member 3 is shown raised and extending towards the second planar restraining member 5.

The case advance finger 132 is shown in a lowered position within the case 38. Its position does not interfere with the advance of case 38 but will ensure the hanging plate 34 and the second planar restraining member 5 do not retract too far and descend beyond the case 38. The control of the position of upper flap 43 is also significant for case flaps that are near the limit of the mechanism's height capability. The second planar restraining member 5 may deflect the upper flaps rather than rise over them, allowing even larger cases to be processed, but it is preferable for the planar restraining members 3 and 5 to rise above the case flaps during the change from one case to another.

Figure 5F:
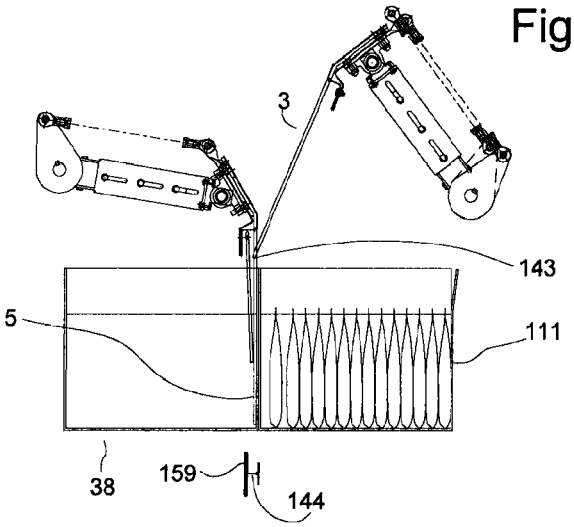

FIG. 5*f* shows the second planar restraining mechanism 5 fully lowered into the new case 38 and at a nominally vertical orientation substantially parallel to the leading internal face of the next case 38. The first planar restraining member 3 is shown extended and interleaved 143. For some cases, the first planar restraining member 3 will begin descending at this point in the cycle. The filled case 111 has been advanced a small distance 144. If the upper flap 43 was moved back during the raising of the second restraining member 5, the advance of the second restraining member 5 to the position shown in FIG. 5*f* is effective in returning the upper flap 43 to a vertical position and clear of the interleaving 143.

Figure 5G:
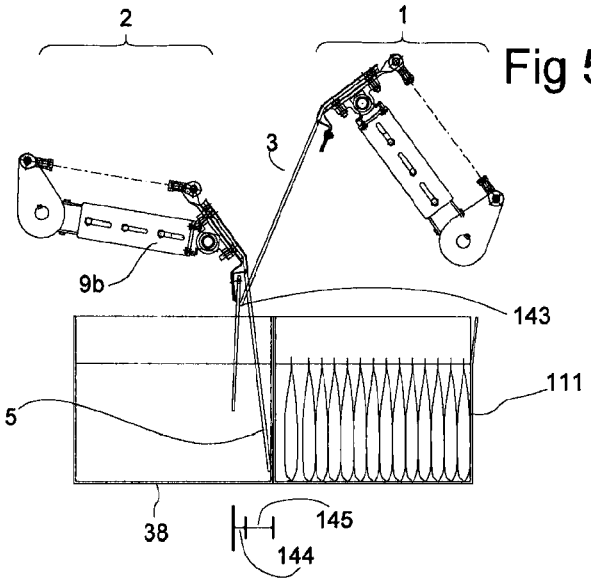

FIG. 5*g* shows the empty case 38 and the filled case 111 advanced a further distance 145 by an additional advancement force applied by the second planar restraining member 5 as it moves independently of the second supporting arm 9*b* in the container advancement configuration. The first planar restraining member 3 is further interleaved for this arrangement and may begin descending. The first planar restraining member 3 may begin descending for the case 38 position shown in FIG. 5*f* and the second planar restraining member 5 may continue advancing the new case 38 and the filled case 111 to the position shown in FIG. 5*g*. This removes any requirement for the first planar restraining member 3 to advance the new case 38 after completing the descent into the new case 38.

Figure 5H:
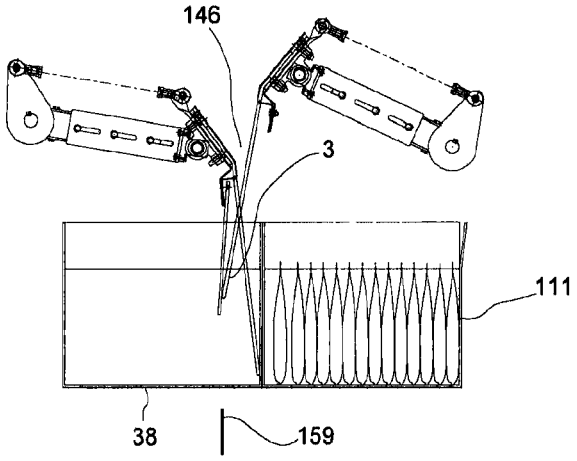

FIG. 5*h* shows the first planar restraining member 3 partially descended into the new case. If a flexible object is deposited into region 146 at this point, the flexible object would descend into the new case 38 and would be deposited at the bottom of the newly presented cavity within the new case 38. This permits the first flexible object for the new case 38 to start falling down the chute 33 a little earlier, thus avoiding the need to buffer supply, and effectively reducing the duration of the cavity recreation process when changing between cases.

Figure 5I:
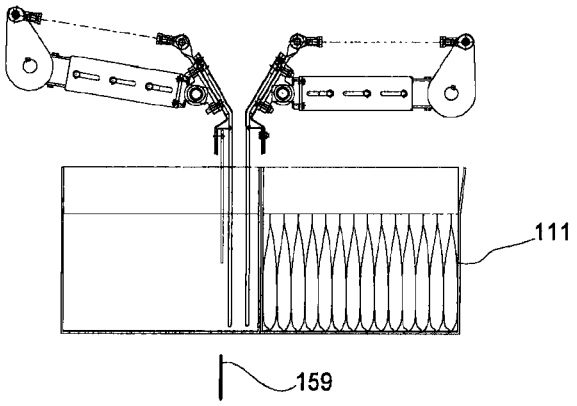

FIG. 5*i* shows the completion of the change from filled case to empty case. After a flexible object is deposited into the presented cavity, the cycle shown in FIGS. 4*a* to 4*f* will be used to recreate another empty cavity for deposition of a further flexible object.

There are several benefits to this method of cavity recreation in a new case 38:

- The empty case 38 can be presented a little earlier and the case advance mechanism 39 need not remain in position but can begin retracting to begin advancing the next case. Alternatively, the case advance mechanism 39 can move back within the empty case 38 and provide guidance for the plate 34 hanging behind the second planar restraining member 5 and also for the second restraining member 5 itself if required. This is particularly beneficial for short cases. Another member could be positioned to provide the same guidance function if the empty case was advanced by means of a conveyor belt, pneumatic cylinder or other means.
- The empty case 38 need not be positioned precisely. This allows for simple case advance methods, such as conveyor belts or pneumatic cylinders.
- There is no need for a synchronized movement of the case advance mechanism 39 with the first and second planar restraining members 3, 5 during creation of a first cavity in a new case. This simplifies the control of the machine.
- The motions required of the second and first planar restraining members are similar and can be performed with considerable overlap. This allows this method of cavity recreation from a filled case to an empty case to be performed rapidly.

Figure 6:
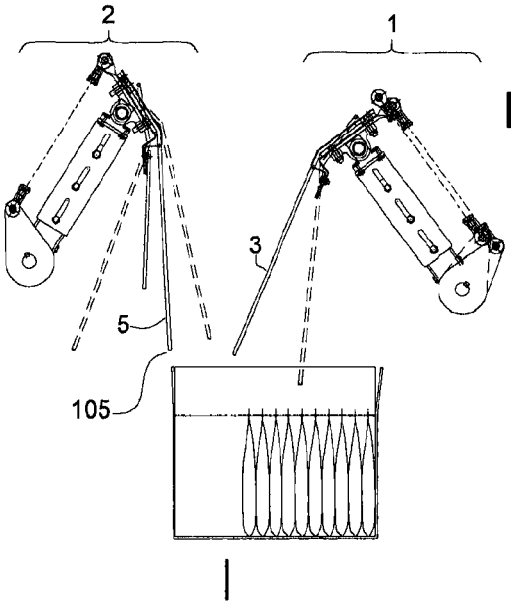
FIG. 6 shows the range of movement of a pair of restraining members for a machine according to one embodiment of the invention.

If the empty case 38 is advanced further by case advance assembly 39 or by alternative means after the first and second planar restraining members 3, 5 have withdrawn from the filled case 111, the first planar restraining member 3 may begin descending as soon as the empty case 38 has advanced sufficiently, either due to the actions of the second planar restraining member 5 or solely due to the advance provided by the alternate means. The second planar restraining member 5 will still descend in the same way but the motions may be closer to simultaneous than sequential, providing an even faster cycle but with the need for a synchronised case advance while both planar restraining members are raised. FIG. 6 shows the configuration of the arms and possible positions of the planar restraining members while waiting for a partially filled case to be moved forward sufficiently to allow another empty case to be moved into place. This configuration may also apply if the empty case is advanced by separate means. The retraction of the lower edge of the second planar restraining member 5 before being lowered into the empty case still provides benefits of ensuring sufficient advancement of the empty case and avoiding damage to the inside leading face of the newly advanced empty case which could be caused by the descending lower edge of the second planar restraining member 5 if this was advanced too soon as it descends.

The skilled person will also note that the concentric shaft assembly configuration shown in FIGS. 2 and 3 is also advantageous for supporting and controlling the case advance assembly 39.

Figure 7:
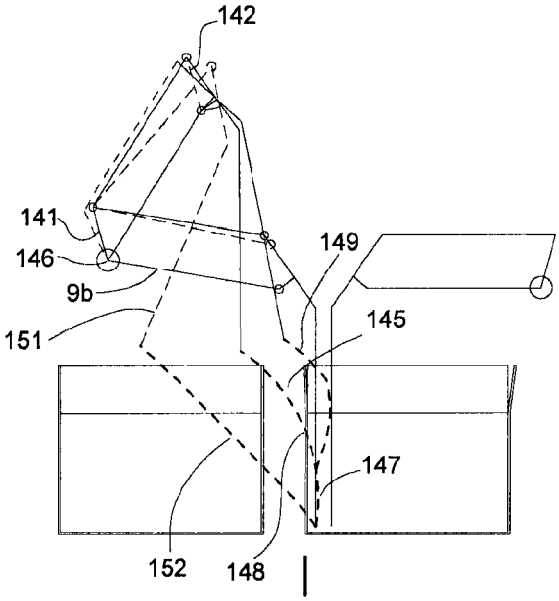
FIG. 7 shows an alternative pair of restraining members usable with embodiments of the present invention.

FIG. 7 shows an alternative arrangement of the two assemblies 1, 2 in which the effect of equal lengths of the levers 141 and 142 is shown in solid line and the effect of shortening lever 142 slightly is shown by the dotted outline labelled 151. Note that the raising of the support arm 9*b* with equal length levers 141 and 142 will automatically retract the second planar restraining member 5. The path followed is 145. Because the pivotal mounting 146 of the supporting arm 9*b* for the second restraining member 5 is positioned so that the supporting arm 9*b* is tilted down to begin with, the second planar restraining member 5 moves slightly forward 147 as it rises. The pivotal support of the second restraining member 5 moves slightly forwards horizontally, then back, to provide nearly vertical movement for the first phase of withdrawal of the second restraining member 5 from the container. This geometry provides two benefits: the pressure applied to the inner face of the container by the second planar restraining member 5 is reduced, and less rotation of the second restraining member 5 is required for the lower edge 105 to withdraw from the container without pressing against the trailing inner surface of the container. A similar configuration may be beneficial for the first restraining assembly.

Note that the path 145 (for levers 141 and 142 of equal length) might damage the upper section of a tall case, where the path 145 passes through the case 111 outline as shown at 148. To avoid damage to the filled case 111, the lower edge 105 of the second planar restraining member 5 may be rotated forward after rising above the deposited bags during withdrawal from the filled case 111, which can be performed with the normal actuator motion used in advancing bags when recreating the cavity within a case. The resulting profile 149 is shown moving well clear of the case 111. When the second planar restraining member 5 is raised, it is retracted and then lowered as described above.

If the lever 142 is shortened as shown at 151, the long dash outline 152 shows the motion of the lower edge 105 of the second planar restraining member 5 with no additional rotation applied to the restraining member by the restraining member actuator. The retraction shown is due to the change from a parallelogram as described by 141 and 142 in FIG. 5*b*, and provides the additional retraction required for the change of case method described, without requiring a separate actuator or a longer actuator stroke, the retraction is a part of the tooling configuration for the second assembly. The forward advance required to avoid damaging the case 111 (to avoid interaction 148) may be achieved in the manner described in the previous paragraph to follow the profile 149. A tilt of the second restraining member 5 advances the lower edge 105 to present a tapered cavity. This tilt is beneficial in the withdrawal of the second restraining member 5 from the case 111, especially for taller cases.

The second restraining member actuator may be arranged in an opposite manner to the first restraining member actuator to force advance as shown in FIG. 5*g* and allow retraction of the second restraining member to be guided by the inner face of the first container as it is withdrawn.

When retracted, the second restraining member 5 may be lowered into the empty case 38 by pivoting of the support arm 9*b*, with the linkage configuration, effectively a four-bar mechanism providing an effective path similar to that shown as 152. Note that this is a mechanically synchronized motion and makes no demands on the machine controller for servo co-ordination or any other type of synchronization. In addition to simplicity, the motion may also be performed extremely quickly and reliably.

Figure 8:
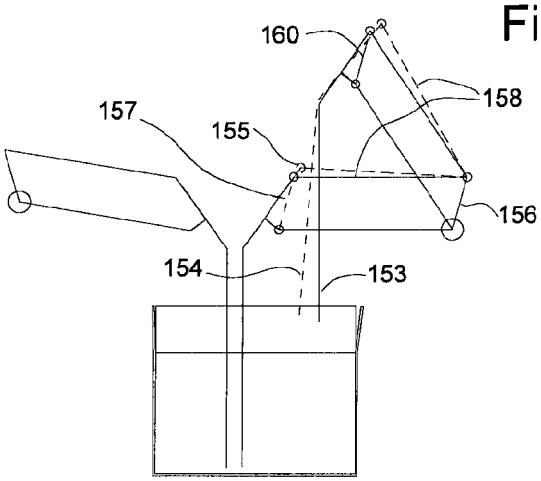
FIG. 8 shows another alternative pair of restraining members usable with embodiments of the present invention.

FIG. 8 shows a similar alternative arrangement for the first planar restraining member 3, which is shown in a raised position 153 with the lever length 156 parallel and of equal length to the lever length 160 of the first planar restraining member 3. The raised position 154 is realised by shifting the connection point of the linkage 158 to the first planar restraining member to 155 (here shown in the lowered position), which creates a longer lever length 157. When the supporting arm 9*a* is raised, the first planar restraining member 3 is advanced to the position 154 shown. The benefit is that as the first support arm 9*a* is raised higher, as is necessary when changing from one case to another, the lower edge of the first planar restraining member will extend further as a consequence. Noting that the planar restraining members and the linkages (such as 158) may be exchanged as part of the product size change, the degree of additional extension may be adjusted to be different for different products.

Persons skilled in the art will perceive additional modifications and embodiments of the invention that nevertheless fall within the inventive concept as encompassed by the claims annexed hereto.

The invention claimed is:

1. A device for filling and advancing a series of containers including a first container and a next container, the device including:

a first assembly including a first restraining member; and a second assembly including a second restraining member, the second assembly being located upstream of the first assembly as referenced to a container advancement direction;

wherein the first and second assemblies are positionable relative to each other in at least the following configurations:

(i) an object-receiving configuration in which the first restraining member and the second restraining member are inserted into the first container, and at least partially define a gap therebetween for deposition of an object;

(ii) a transitional configuration in which the second restraining member is raised relative to the first container, and a lower portion of the second restraining member is positioned above and behind a leading internal face of the next container such as to be insertable into the next container; and (iii) a container advancement configuration in which at least part of the second restraining member is in direct contact with and applying an advancement force to the leading internal face of the next container for moving the next container in the container advancement direction.

2. A device according to claim 1, wherein the second assembly includes a restraining member actuator for independent movement of the second restraining member relative to the remainder of the second assembly.

3. A device according to claim 2, wherein the independent movement is rotational.

4. A device according to claim 3, wherein the second assembly includes a support arm to which the second restraining member is pivotally mounted.

5. A device according to claim 4, wherein the support arm and the second restraining member are coupled by a linkage assembly arranged to impart movement to the second restraining member at least during some stage of pivotal movement of the support arm.

6. A device according to claim 4, wherein, in at least the object-receiving configuration, the pivotal mounting of the second restraining member is lower than a pivotal mounting of the support arm, such that during movement of the second assembly from the object-receiving configuration towards the transitional configuration, a lower edge of the second restraining member moves away from a trailing internal face of the first container.

7. A device according to claim 2, wherein in the container advancement configuration, the independent movement results in an additional advancement force being applied to the leading internal face of the next container; and in the object-receiving configuration, the independent movement results in application of an additional advancement force to objects previously deposited in the first container.

8. A device according to claim 1, wherein in the container advancement configuration, the second restraining member is substantially parallel to the leading internal face of the next container.

9. A device according to claim 1, wherein the first assembly is similar in construction, but is enabled to rotate in the opposite sense, to the second assembly.

10. A device according to claim 1, further including position sensors for monitoring the movement of the first and/or second restraining members to detect when the first and second assemblies are in the object-receiving configuration.

11. A device according to claim 1, further including a container advancement assembly which is positionable to partially advance the next container and to guide the second restraining member into the next container.

12. A device according to claim 11, wherein the second restraining member includes a guide plate, and wherein the container advancement assembly is positioned relative to the second assembly to assist in guiding the second restraining member and guide plate into the next container if the second restraining member is retracted close to or beyond a trailing end of the next container.

13. A device according to claim 11, wherein the container advancement assembly includes case advance fingers positionable in the next container, and wherein the guide fingers are arranged for interleaving with the first and second restraining members during before the first and second restraining members begin their descent into the newly positioned next container.

14. A first restraining assembly for use with a device for filling and advancing a series of containers including a first container and a next container, the first restraining assembly including a first restraining member, wherein the first restraining assembly is positionable relative to a second similar restraining assembly in at least the following configurations:

(i) an object-receiving configuration in which the first restraining member is inserted into the first container and at least partially defines, with a second restraining member of the second restraining assembly, a gap for deposition of an object;

(ii) a transitional configuration in which the second restraining member is raised relative to the first assembly, and a lower portion of the second restraining member is positioned above and behind a leading internal face of the next container to be insertable into the next container; and (iii) a container advancement configuration in which at least part of the second restraining member is in direct contact with and applying an advancement force to the leading internal face of the next container to advance the next container in a container advancement direction from the second restraining member to the first restraining member.

15. A device for filling and advancing a series of containers including a first container and a next container, the device including:

a first assembly including a first restraining member; and a second assembly including a second restraining member, the second assembly being located upstream of the first assembly as referenced to a container advancement direction;

wherein the first and second assemblies are positionable relative to each other in at least the following configurations:

(i) an object-receiving configuration in which the first restraining member and the second restraining member are inserted into the first container, and at least partially define a gap therebetween for deposition of an object;

(ii) a transitional configuration in which the second restraining member is raised relative to the first container, and a lower portion of the second restraining member is positioned above and behind a leading internal face of the next container such as to be insertable into the next container for moving the next container in the container advancement direction; and (iii) a container advancement configuration in which at least part of the second restraining member is in contact with and applying an advancement force to the leading internal face of the next container, with the next container being empty.

16. A first restraining assembly for use with a device for filling and advancing a series of containers including a first container and a next container, the first restraining assembly including a first restraining member, wherein the first restraining assembly is positionable relative to a second similar restraining assembly in at least the following configurations:

(i) an object-receiving configuration in which the first restraining member is inserted into the first container and at least partially defines, with a second restraining member of the second restraining assembly, a gap for deposition of an object;

(ii) a transitional configuration in which the second restraining member is raised relative to the first assembly, and a lower portion of the second restraining member is positioned above and behind a leading internal face of the next container to be insertable into the next container; and (iii) a container advancement configuration in which at least part of the second restraining member is in contact with and applying an advancement force to the leading internal face of the next container to advance the next container in a container advancement direction from the second restraining member to the first restraining member, with the next container being empty.

* * * * *